US006889933B2

(12) United States Patent
Straaten et al.

(10) Patent No.: US 6,889,933 B2
(45) Date of Patent: May 10, 2005

(54) TUBE PLATE FOR A CREEL

(75) Inventors: Paul Straaten, Schwalmtal (DE); Dietmar Engelhardt, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 31 days.

(21) Appl. No.: 10/424,893

(22) Filed: Apr. 28, 2003

(65) Prior Publication Data

US 2004/0004150 A1 Jan. 8, 2004

(30) Foreign Application Priority Data

Apr. 27, 2002 (DE) ..... 102 18 993

(51) Int. Cl.[7] ..... B65H 16/06

(52) U.S. Cl. ..... 242/596.3; 242/586.4; 242/596.7; 242/571.4

(58) Field of Search ..... 242/596.3, 586.4, 242/586.6, 129.51, 596.7, 571.7, 571.3, 486.2, 476.6, 476.5, 473.7, 473.8

(56) References Cited

U.S. PATENT DOCUMENTS

| | | | | | |
|---|---|---|---|---|---|
| 2,865,577 | A | | 12/1958 | Fürst | 242/129.5 |
| 3,433,433 | A | * | 3/1969 | Elias et al. | 242/129.51 |
| 3,704,837 | A | * | 12/1972 | Heinz et al. | 242/571.3 |
| 3,921,921 | A | * | 11/1975 | Katayama et al. | 242/476.5 |
| 4,045,038 | A | * | 8/1977 | Obenshain | 279/2.24 |
| 4,148,444 | A | * | 4/1979 | Hehner | 242/571.3 |
| 4,291,844 | A | * | 9/1981 | Blickley et al. | 242/571.4 |
| 4,299,357 | A | * | 11/1981 | Munker | 242/476.6 |
| 4,821,974 | A | * | 4/1989 | Poehlein | 242/596.4 |
| 4,848,689 | A | | 7/1989 | Demuth et al. | 242/18 DD |
| 5,248,103 | A | * | 9/1993 | Polnik | 242/476.6 |
| 5,263,656 | A | * | 11/1993 | Raasch | 242/476.3 |
| 5,820,069 | A | * | 10/1998 | Segura Salvador et al. | 242/571.3 |
| 6,666,398 | B2 | * | 12/2003 | Allegretto et al. | 242/476.6 |
| 2003/0029153 | A1 | | 2/2003 | Straaten | 57/263 |

FOREIGN PATENT DOCUMENTS

| | | |
|---|---|---|
| CH | 339102 | 7/1959 |
| DE | 2 312 609 | 10/1974 |
| DE | 29 23 320 A1 | 10/1980 |
| DE | 84 36 149 U1 | 5/1986 |
| DE | 38 37 337 C2 | 5/1989 |
| DE | 43 43 866 A1 | 6/1995 |
| EP | 0 088 708 A2 | 9/1983 |
| EP | 0 262 443 A1 | 4/1988 |
| EP | 0 350 786 A1 | 1/1990 |
| GB | 1 466 421 | 3/1977 |
| GB | 2 018 841 A | 10/1979 |
| GB | 2 044 813 A | 10/1980 |
| GB | 2 147 624 A | 10/1984 |

* cited by examiner

*Primary Examiner*—Eileen D. Lillis
*Assistant Examiner*—Evan Langdon
(74) *Attorney, Agent, or Firm*—Kennedy Covington Lobdell & Hickman, LLP

(57) ABSTRACT

A tube plate supported in a freely rotatable manner in a creel of a cheese-producing textile machine is provided with a tensioning cone that fits into the cheese tube and fixes it. The tube plate includes a base body with the tensioning cone and a clamping ring, axially movable relative to and supported on the base body.

15 Claims, 6 Drawing Sheets

TUBE PLATE FOR A CREEL

FIELD OF THE INVENTION

The invention relates generally to a tube plate for the creel of a yarn-cheese-producing textile machine, and more specifically to a tube plate having a tensioning cone that fits into the cheese tube and a clamping ring movable relative thereto.

CROSS-REFERENCES TO RELATED APPLICATIONS

This application claims the benefit of German patent application 10218993.5, filed Apr. 27, 2002, herein incorporated by reference.

BACKGROUND OF THE INVENTION

The tube plate of a creel for a cheese-producing textile machine is generally used to center the cheese tube within the creel and to assist the holding of the cheese tube by tension against the creel arm as the cheese is formed by winding yarn about the tube. Various conventional tube plates are known and described in the prior art.

For example, a tube plate as shown and described in German Patent No. DE 43 43 866 A1 comprises a cylindrical centering attachment whose greatest outside diameter is somewhat smaller than the smallest inside diameter of the tube. The cheese tube is fixed in the creel substantially via its lateral edges between radially projecting contact surfaces of the tube plate. That is, there is generally a little play between the inside diameter of the tube and the outside diameter of the centering attachment of the tube plate.

This tolerance-conditioned play between tube plate and tube does have advantages if, as described in German Published Patent Application No. DE 101 39 072.6, a new yarn is to be fixed between the tube plate and a lateral edge of the tube during the restarting of spinning at a workstation and the tube plate is slightly tilted so that, using a so-called tube-plate opener of a service unit, a yarn strand can be fixed in the resulting slot. However, such tube plates, because they are supported in an oscillating manner, also have some not insignificant disadvantages that become evident during the winding process.

During the winding process, for example, the tube plate rotates constantly relative to the tube, which results in, among other things, a distinct wearing of the tube plate and, occasionally, the fixed yarn wearing through, with the possible consequence that the yarn reserve unwinds. Moreover, the play between tube and tube plate hinders the transmission of bobbin oscillations onto the creel, which oscillations are then often defectively absorbed by the oscillation damper of the creel, creating bobbins of a poorer quality.

Play between the tube and the centering attachment of the tube plate also has a particularly negative effect in the production of cheeses wherein the exact bobbin speed must be ascertained, such as in stepped precision winding, wherein the quality of the yarn package is determined by the performance of the winding head computer. The bobbin speed can be determined rather simply using a Hall effect sensor on the creel and one or several magnets on the tube plate, provided, however, that the tube plate rotates exactly at the speed of the bobbin. This condition requires that there be no slip between the tube plate and the cheese tube.

The disadvantages described above can be avoided to a great extent by using a tube plate like the one described, for example, in German Patent No. DE 38 37 337 C2. This tube plate comprises conical tube receptacles whose large outside diameter is distinctly larger than the inside diameter of the tubes. In such an arrangement the tube is centered and fixed directly by the conical tube receptacles.

However, such tube plates are disadvantageous when a spinning restart is to be made at a workstation according to the method described in German Published Patent Application No. DE 101 39 072.6. These known tube plates are particularly unsuitable for fixing the new yarn between the lateral edge of the tube and between the tube plate since such a tube plate, when it is designed for an oscillating motion and is tilted in order to allow the yarn end to be clamped, is subsequently no longer securely aligned with the axis of rotation of the tube. Rather, such a tube plate results subsequently in a wobbling motion when winding on a yarn. Therefore, the tube plates according to German Patent No. DE 38 37 337 C2 have spiral grooves for fixing a new yarn, which grooves, in theory, draw the yarn under the tube and fix it there. However, this method is unreliable in practice.

SUMMARY OF THE INVENTION

There is therefore a need for a tube plate arrangement in which the contact between the tube plate and the cheese tube is reliably slip-free and in which the yarn can be readily and reliably fixed on the cheese tube during a spinning restart at a workstation.

In accordance with the previously identified needs, the present invention includes a tube plate rotatably supported in a creel of a textile machine for producing cheeses and having a tensioning cone that fits into and fixes the cheese tube, the tube plate including a base body with a fixed (relative to the base body) tensioning cone and a movable (relative to the base body) clamping ring supported on the base body.

The present invention has a particular advantage over conventional tube plates in that the operations of tensioning the tubes and clamping the yarn are separate. That is, the tube positioned in the creel remains play-free and correctly centered within the creel by the tensioning cone of the base body, while the yarn is securely fixed between the clamping ring and the lateral edge of the tube.

In another feature of the present invention, the tensioning cone of the base body includes a number of guide grooves circumferentially arranged on the tensioning cone, and movement of the clamping ring is guided by guide webs that are sized to cooperate with the guide grooves. Such an arrangement assures both that no rotary relative motion can occur between the cheese tube (as fixed by the tensioning cone) and the clamping ring and that the clamping ring can be tilted as needed, as when the yarn is to be fastened. The yarn to be fastened can be subsequently placed into the gap between the lateral edge of the tube and the clamping ring (produced by tilting the clamping plate) and can be held in place by tilting the clamping ring back.

Another feature of the invention provides for a spring element, which is arranged behind the clamping ring and ensures that the clamping ring is constantly loaded in the direction of the tube, even during winding. Specifically, the base body includes a bearing shoulder that has radially projecting stops on the side opposite the tensioning cone, on which stops the spring element for loading the clamping ring is supported. In accordance with this feature of the present invention, the clamping ring constantly rests flat against the lateral edge of the tube during winding and reliably clamps a yarn positioned between the clamping ring and the lateral edge.

In still another feature of the present invention, the guide webs are provided on the back thereof with path-limiting shoulders that correspond to the radial stops on the bearing shoulder of the base body. These path-limiting shoulders limit the axial movement of the clamping ring relative to the base body and ensure that the spring element can be positioned securely and reliably between the path-limiting shoulders and the bearing shoulder.

The clamping ring is connected, in another feature of the present invention, to the base body via a spring element such that the clamping ring is supported in an oscillating manner relative to the central axis of the tube plate to allow for yarn clamping but, during winding, rests flat against the front surface of the tube. Specifically, the clamping ring is connected to the base body via a spring element such that the clamping ring may tilt relative to the axis of the tube plate.

Another feature of the present invention provides that the base body is equipped on its outside circumference with guide noses corresponding to radially arranged recesses or apertures in the clamping ring. This permits the clamping ring to be connected to the base body so that the clamping is both co-rotational with and axially movable in relation to the base body. This feature, incidentally, ensures that the yarn fixed between the clamping ring and the lateral edge of the tube is not exposed to frictional forces during winding.

In yet another feature of the present invention, the spring element is manufactured of a highly elastic material, such as (and preferably) rubber, and is provided with connection flanges having a comparatively large surface area. The spring element is fastened by an outer flange to the clamping ring and by an inner flange to the base body. Alternatively, the spring element is made of spring steel, and is preferably fastened on its inner flange to the base body, while the outer flange extends behind the clamping ring. In this alternative embodiment, the use of spring steel functions reliably and has a comparatively long service life, and is particularly useful where it is necessary or desirable to achieve high tensioning forces in a simple manner.

The present invention also features, in some embodiments, a steel spring element wherein the inner flange is designed as a closed ring, but the outer flange includes a plurality of radially arranged lamellae or fingers. Such a spring element may be securely fixed to the base body but is also highly elastic.

In another feature of the present invention, the tensioning cone has at least two areas of differing conicity. The area located in the front preferably has the greater conicity, which distinctly simplifies setting the tube on the tensioning cone.

Both the base body of the tube plate and the clamping ring, in a further feature of the present invention, are manufactured from plastic, and may be preferably formed through injection molding or die casting. In accordance with this feature, the tube plate may be manufactured economically and yet retain a long service life.

A further feature of the present invention provides for a clamping ring that includes at least one yarn positioning means including a pin loaded by a pressure spring, which pin rests upon the lateral edge of the cheese tube.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
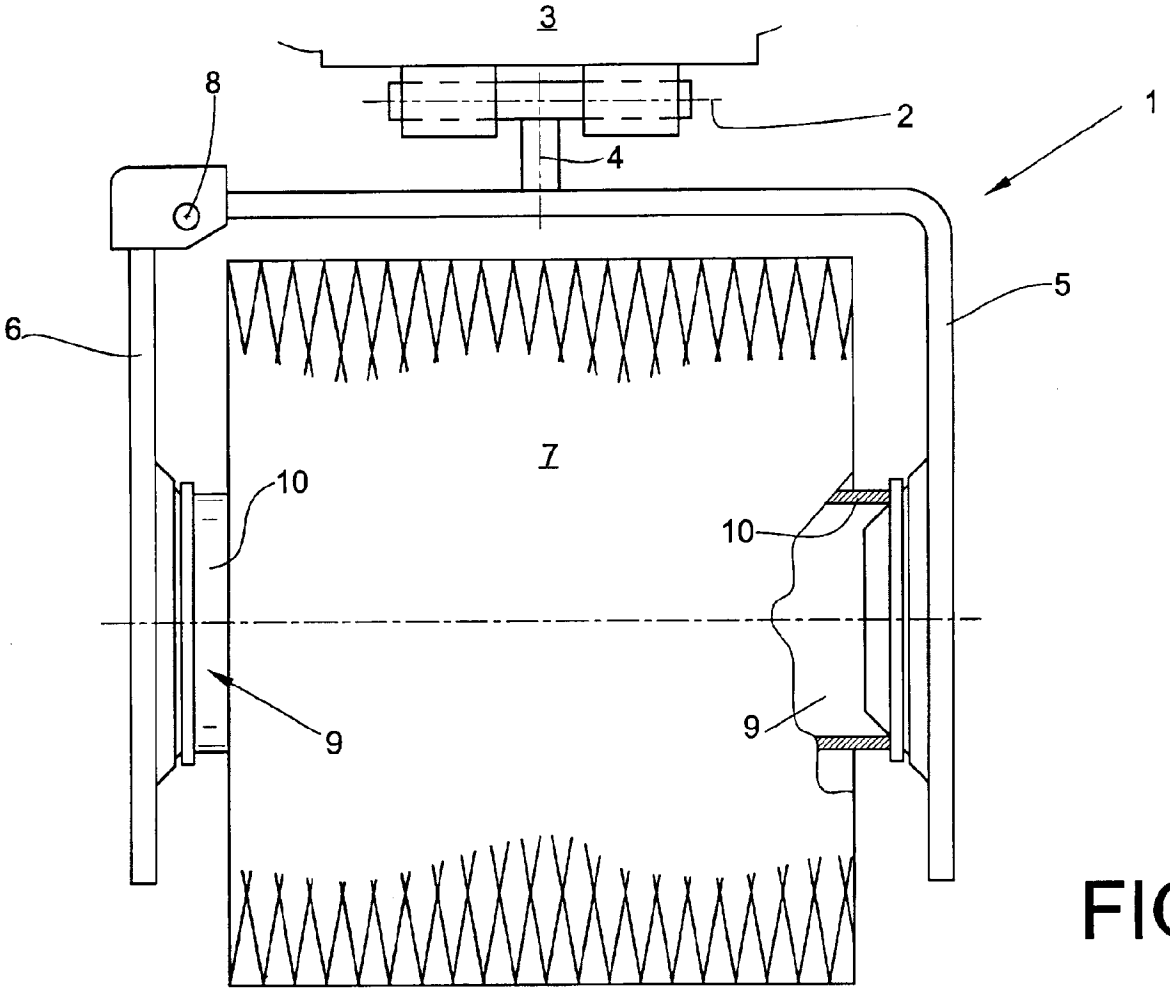
FIG. 1 is a schematic representation of a creel of a cheese-producing textile machine having the tube plate according to the invention in the area of one of the creel arms.

Referring now to the drawings, FIG. 1 schematically depicts a creel 1 of a cheese-producing textile machine (not shown). The creel 1 is connected via a horizontal pivot shaft 2 to a winding head housing 3 of one of the numerous workstations of the textile machine. A cylindrical cheese 7 is shown in FIG. 1, but creel 1 preferably also comprises a second pivot shaft 4, arranged orthogonally to the first pivot shaft 2, which makes it possible to produce conical cheeses, if required.

As is customary, creel 1 comprises two creel arms 5,6 between which cheese 7 is held is a freely rotatable manner. The creel arm 5 is a component of the basic creel frame whereas the creel arm 6 is connected via pivot shaft 8 and can be pivoted outward to receive or deliver a cheese 7. Tube plates 9 are arranged in the area of the creel arms 5,6 in order to fix and hold the tube 10 of cheese 7 in a freely rotatable manner. At least one of these tube plates 9 has the design of the invention, that is, it consists of a base body with a fixed tensioning cone and a movable clamping ring supported on the base body.

Figure 2:
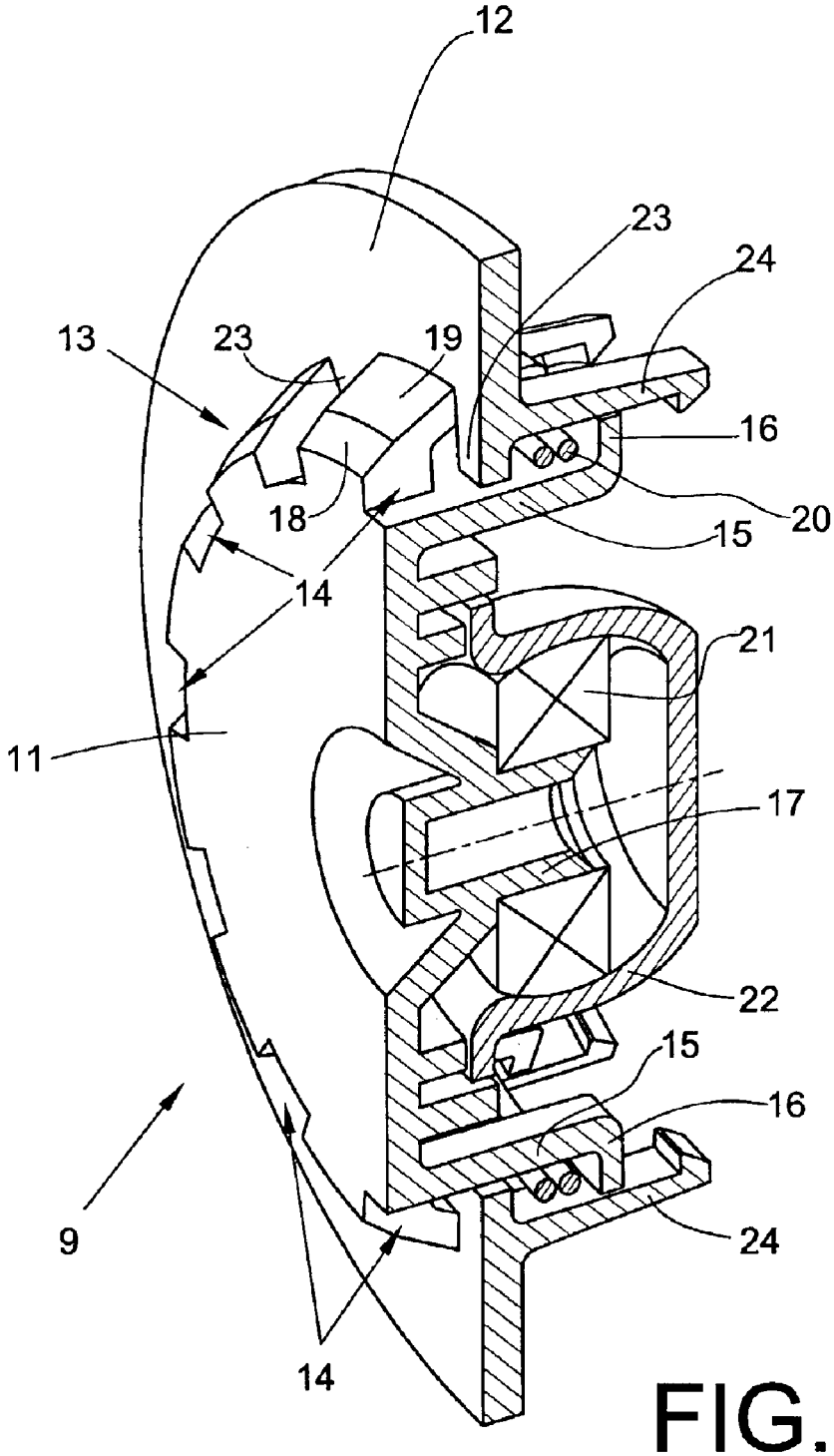
FIG. 2 is a perspective view of a first embodiment of the tube plate of the present invention, in partial cross-section taken vertically along the central axis of the tube plate.

Referring now to FIG. 2, a first embodiment of the tube plate in accordance with the invention is shown in a perspective view with a partial cross-section taken along the central axis of the tube plate 9. As may be seen in the figure, tube plate 9 consists substantially of a base body 11 and a clamping ring 12 supported in such a manner that it can move axially relative to base body 11. Base body 11 of tube plate 9 includes a tensioning cone 13 that comprises numerous radially arranged guide grooves 14 on its circumference. Tensioning cone 13 preferably has at least two areas with differing conicity. That is, area 18 of tensioning cone 13, that is directed toward tube 10, is followed by area 19 having a lesser conicity.

Bearing shoulder 15 is provided with several radially projecting stops 16, and a central pin 17 is formed on base body 11 on the side opposite tensioning cone 13. Radial stops 16 form an abutment for spring element 20, preferably a pressure spring, while central pin 17 engages with the inner ring of bearing 21, which may be a roller or ball bearing. The outer ring of this bearing 21 is supported, as indicated in FIG. 2, in a bushing 22 fixed on one of the two creel arms 5,6.

Clamping ring 12 is provided with radially inwardly directed guide webs 23 that correspond to guide grooves 14 in tensioning cone 13 of base body 11. Additionally, path limiting shoulders 24 are formed on the back side of guide webs 23, which shoulders limit the axial motion of clamping ring 12 in combination with the radial stops 16 of the base body 11.

Figure 3:
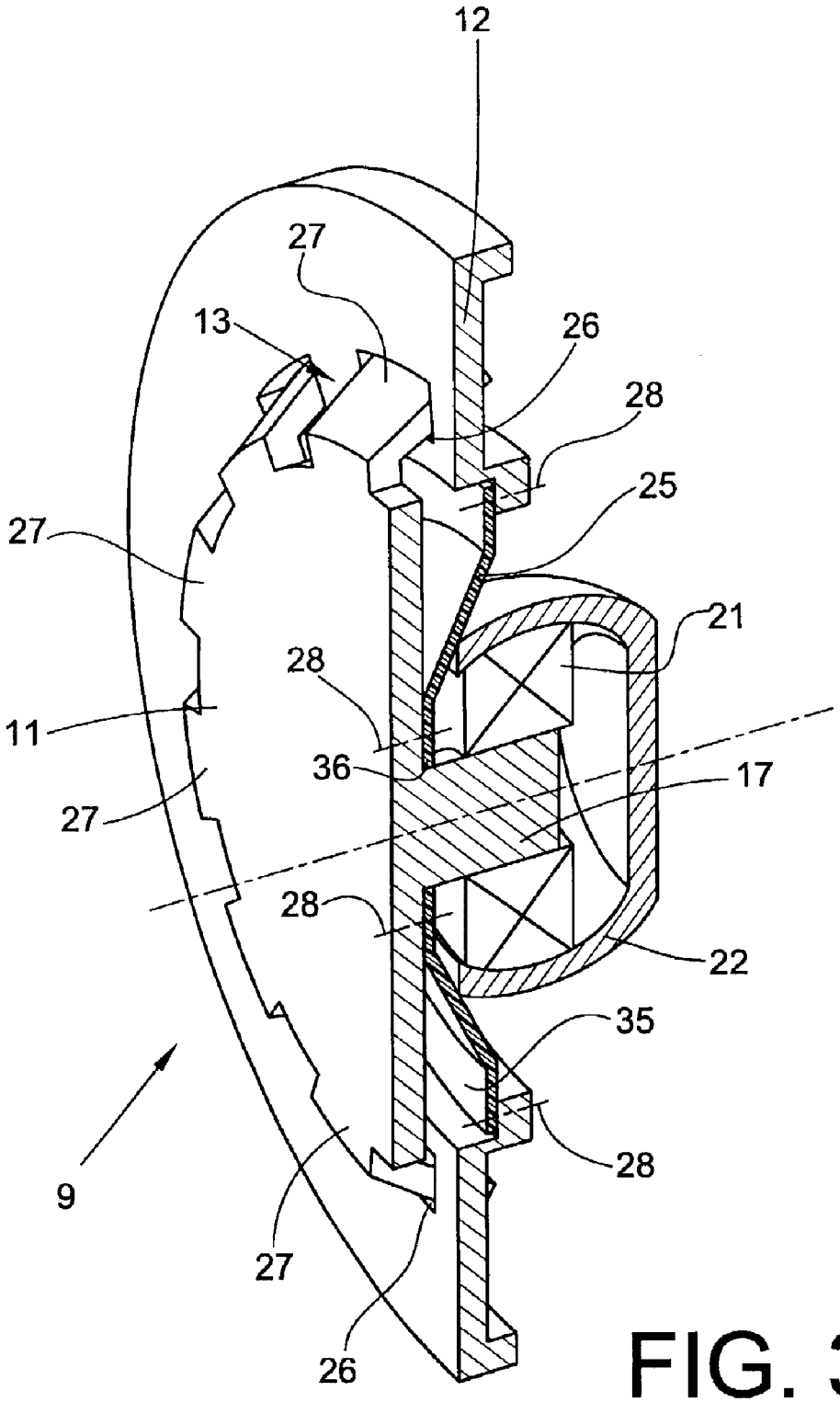
FIG. 3 is a perspective view as in FIG. 2, depicting a second embodiment of the tube plate.
Figure 4:
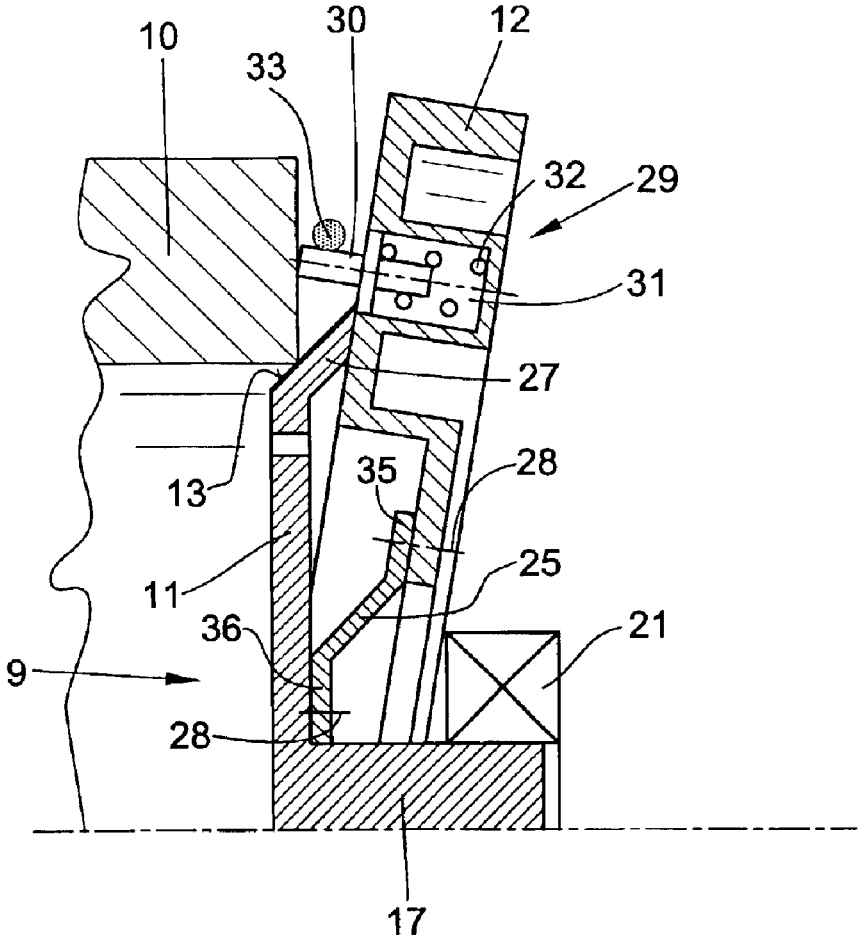
FIG. 4 is a plan view of a portion of the present invention, showing an additional yarn positioning means arranged in the area of the clamping ring.
Figure 5:
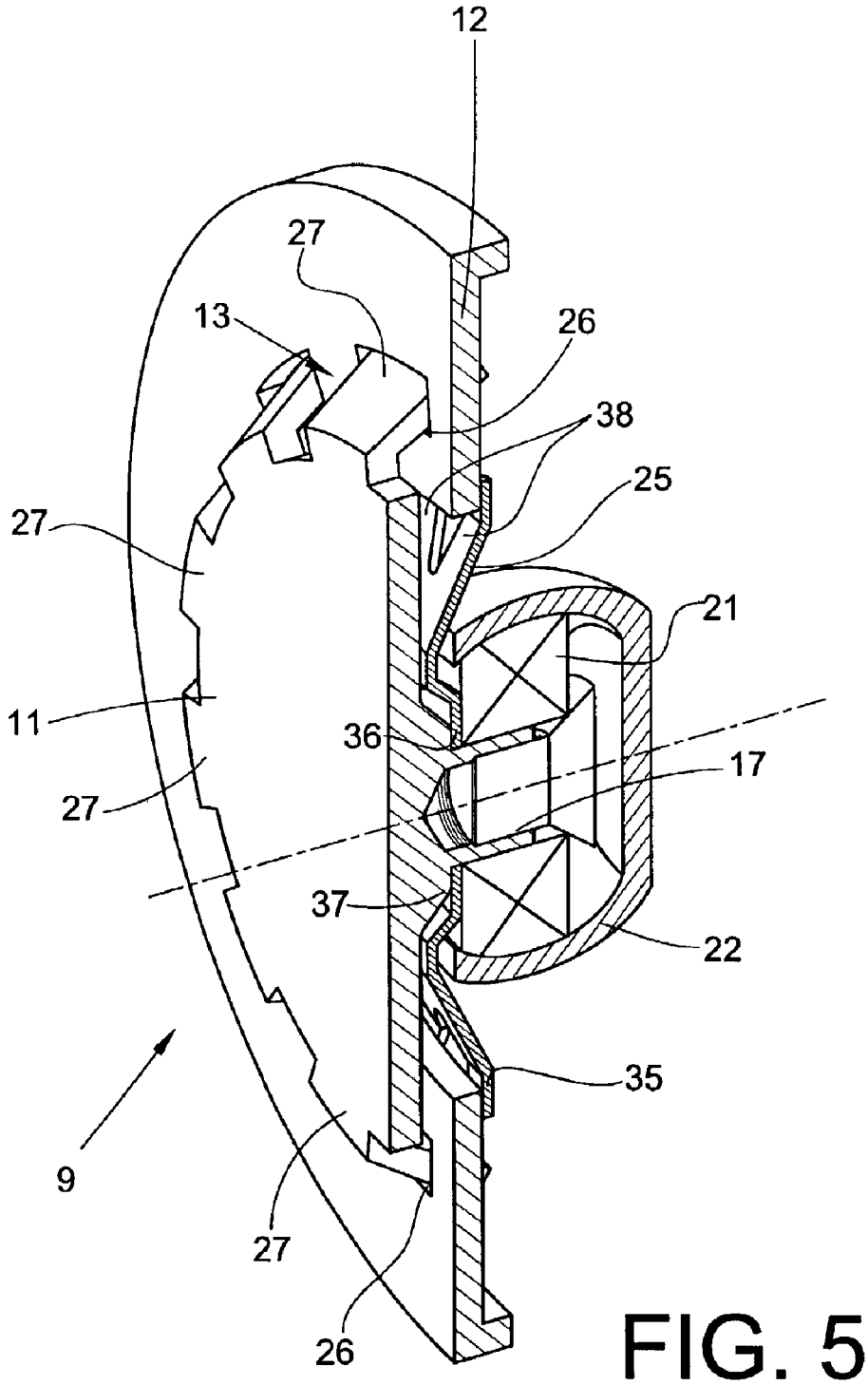
FIG. 5 is a perspective view as in FIG. 2, depicting a third embodiment of the tube plate.
Figure 6:
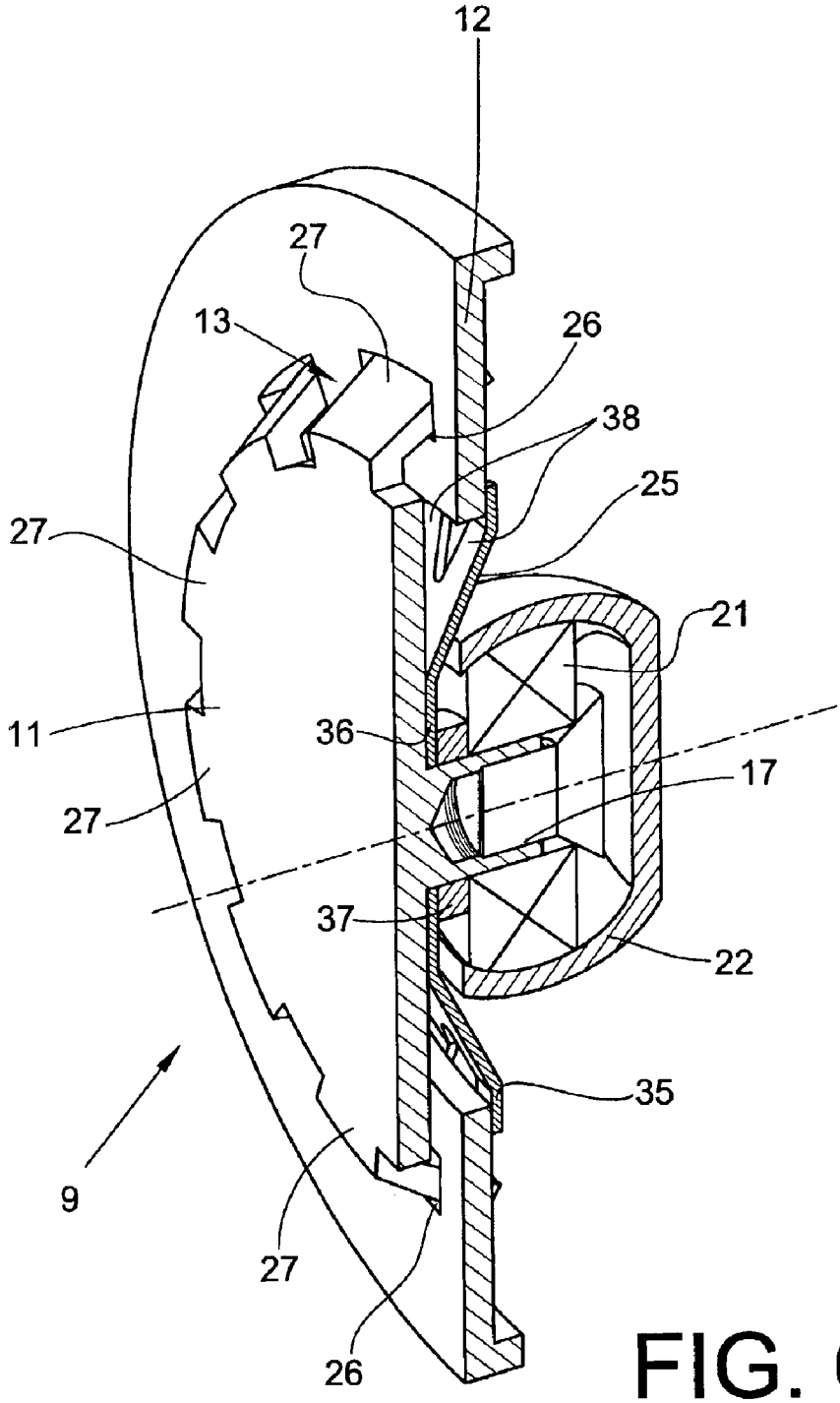
FIG. 6 is a perspective view as in FIG. 5, depicting an alternative embodiment of the tube plate.

Referring now to FIG. 3, a perspective view as in FIG. 2 depicts a second preferred embodiment of a tube plate 9 in accordance with the present invention. This embodiment has a somewhat narrower construction, and, like the embodiments shown in FIGS. 4–6, is comparable in its essential structural components to the tube plate of FIG. 2. Corresponding structural components are therefore provided with the same reference numerals.

Thus, tube plate 9 as shown in FIG. 3 has a base body 11 and a clamping ring 12 supported in such a manner that it can move relative to base body 11. Base body 11 is connected to clamping ring 12 via a spring element 25, which has been manufactured of a highly elastic material, such as rubber. Spring element 25 is positively fixed to base body 11 via inner flange 36 and to clamping ring 12 via outer flange 35 using appropriate fastening means 28. Spring element 25 makes it possible in a simple manner, e.g., by inserting a yarn, to shift clamping ring 12 axially relative to base body 11 and, more specifically, to tilt clamping ring 12.

Additionally, guide noses 27, which are arranged on base body 11 and correspond with radial recesses or apertures 26 in clamping ring 12, assure that clamping ring 12 and base body 11 are connected to one another in such a manner that they rotate in unison.

Referring now to FIG. 4, a plan view depicts a yarn positioning means 29 which is integrated into clamping ring 12. This yarn positioning means 29 consists, in a preferred embodiment, of a pin 30 disposed in blind hole 31 or the like and is loaded in the direction of tube 10 by, for example, pressure spring 32. As FIG. 4 indicates, the pin 30 rests constantly on the lateral edge of tube 10 and forms a defined contact surface for yarn 33 to be clamped, especially when tube 10 has a thick wall.

FIGS. 5 and 6 show tube plates 9 slightly modified from the embodiment depicted in FIG. 3. These tube plates 9 differ from previously described tube plate 9 in the particular design and the fixing of spring element 25 inserted between base body 11 and clamping ring 12. Specifically, these tube plates 9 have a spring element 25 manufactured from a more durable material such as spring steel. Spring element 25 has a closed inner flange 36 and a slotted outer flange 35. Outer flange 35 is provided with a plurality of radially arranged lamellae 38, or fingers, extending behind clamping ring 12 in a non-positive manner, and spring element 25 is fixed only to base body 11. That is, inner flange 36 of spring element 25 is either, as FIG. 5 indicates, curved somewhat to the rear and clamped between an annular shoulder of bearing 21 and the inner ring (not shown) of spring element 25, or inner flange 36 of spring element 25 is fixed, as shown in FIG. 6, by means of spacer 37 between base body 11 and the inner ring of bearing 21.

The structure of the tube plate according to the present invention having been described above, the operation thereof may now be described in detail.

As is known, the workstations of yarn-cheese-producing textile machines are supplied by automatically operating service units that patrol along the various workstations of the textile machine and engage with the workstations as needed.

If, for example, it is necessary for the cheese and tube to be changed at one of the workstations, the service unit positions itself at the workstation, transfers the finished cheese 7 onto a cheese removal device, and places a new, empty cheese tube 10 into creel 1 of the workstation. By that operation, a new empty tube 10 is fixed in a freely rotatable manner between freely rotatable supported tensioning cones 13 of tube plate 9.

Subsequently, as described, for example, in German Published Patent Application No. DE 101 39 072.6, a restart of the spinning process is made using an auxiliary yarn made available from the service unit. The running thread is drawn out by a suction nozzle in the workstation and is brought, using a special yarn-placing device into the range of the creel 1. The service unit uses a tube-plate opener and tilts the clamping ring 12 somewhat to the outside, creating a slot. The yarn, having been held ready in the yarn placing device of the service unit, is placed into the slot and securely fixed between the lateral edge of tube 10 and clamping ring 12 of tube plate 9 after the tube-plate opener has been withdrawn. At the same time, tube 10 is lowered onto the drive drum of the workstation and a new winding procedure is started therewith.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A tube plate for rotatable support in a creel of a textile machine for producing cheeses, the tube plate comprising:

a base body with a tensioning cone rigidly fixed thereto and configured to fit by a progressively wedging engagement into a cheese tube without yielding thereto, for fixedly holding the cheese tube; and a clamping ring supported on the base body for yielding movement in an axial direction relative to the base body independently of engagement of the cone in the cheese tube for selectively clamping a yarn between the clamping ring and the cheese tube.

2. The tube plate of claim 1, wherein the tensioning cone comprises a plurality of guide grooves circumferentially arranged on the tensioning cone and movement of the clamping ring is guided by guide webs.

3. The tube plate of claim 2, wherein the base body comprises a bearing shoulder having radially projecting stops on the side opposite the tensioning cone, on which stops a spring element for loading the clamping ring is supported.

4. The tube plate of claim 3, wherein the guide webs comprise path-limiting shoulders corresponding to the stops.

5. The tube plate of claim 1, wherein the clamping ring is connected to the base body via a spring element such that clamping ring may tilt relative to an axis of the tube plate.

6. The tube plate of claim 1, wherein the clamping ring comprises radially arranged apertures corresponding to guide noses of the base body.

7. The tube plate of claim 5, wherein the spring element is formed of a highly elastic material and comprises an outer flange connected to the clamping ring and an inner flange connected to the base body.

8. The tube plate of claim 5, wherein the spring element is formed of spring steel and comprises an inner flange connected to the base body and an outer flange extending behind the clamping ring.

9. The tube plate of claim 8, wherein the inner flange of the spring element comprises a closed ring and the outer flange comprises a plurality of radially arranged fingers.

10. The tube plate of claim 1, wherein the tensioning cone comprises at least two areas of differing conicity.

11. The tube plate of claim 10, wherein the area proximal to the base body has a lesser conicity than the distal area.

12. The tube plate of claim 1, wherein the base body and the clamping ring are formed of plastic.

13. The tube plate of claim 12, wherein the base body and the clamping ring are formed by injection molding.

14. The tube plate of claim 12, wherein the base body and the clamping ring are by die casting.

15. The tube plate of claim 1, wherein the clamping ring comprises at least one yarn positioning means comprising a pin loaded by a pressure spring and resting on the cheese tube.

* * * * *